US010547115B2

(12) United States Patent
Jouanlanne et al.

(10) Patent No.: US 10,547,115 B2
(45) Date of Patent: Jan. 28, 2020

(54) WIRE-PLATE ANTENNA HAVING A CAPACITIVE ROOF INCORPORATING A SLOT BETWEEN THE FEED PROBE AND THE SHORT-CIRCUIT WIRE

(71) Applicant: COMMISSARIAT A L'ENERGIE ATOMIQUE ET AUX ENERGIES ALTERNATIVES, Paris (FR)

(72) Inventors: Cyril Jouanlanne, Grenoble (FR); Christophe Delaveaud, Saint-Jean-de-Moirans (FR); Jean-François Pintos, Saint-Blaise-du-Buis (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/536,265

(22) PCT Filed: Dec. 18, 2015

(86) PCT No.: PCT/EP2015/080631
§ 371 (c)(1),
(2) Date: Jun. 15, 2017

(87) PCT Pub. No.: WO2016/097362
PCT Pub. Date: Jun. 23, 2016

(65) Prior Publication Data

US 2017/0352962 A1 Dec. 7, 2017

(30) Foreign Application Priority Data

Dec. 19, 2014 (FR) ..... 14 63018

(51) Int. Cl.
*H01Q 13/10* (2006.01)
*H01Q 9/04* (2006.01)
*H01Q 9/36* (2006.01)

(52) U.S. Cl.
CPC ..... *H01Q 13/106* (2013.01); *H01Q 9/0421* (2013.01); *H01Q 9/36* (2013.01)

(58) Field of Classification Search
CPC ..... H01Q 13/106; H01Q 9/0421; H01Q 13/16
See application file for complete search history.

(56) References Cited

U.S. PATENT DOCUMENTS 4,733,245 A 3/1988 Mussler
6,750,825 B1 6/2004 Delaveaud et al.
(Continued)

FOREIGN PATENT DOCUMENTS

EP 0 250 832 A2 1/1988
EP 1 241 733 A1 9/2002
(Continued)

OTHER PUBLICATIONS

International Search Report and Written Opinion dated Mar. 4, 2016 issued in corresponding application No. PCT/EP2015/080631; w/ English partial translation and partial machine translation (20 pages).
(Continued)

*Primary Examiner* — Ricardo I Magallanes
(74) *Attorney, Agent, or Firm* — Westerman, Hattori, Daniels & Adrian, LLP

(57) ABSTRACT

A wire-plate antenna (10) comprises a ground plane (11), at least one capacitive roof (12), a feed probe (13) connected to the capacitive roof (12) and intended to be linked to a generator, and at least one electrically conductive short-circuit wire (14) linking the capacitive roof (12) and the ground plane (11). The capacitive roof (12) comprises at least one slit (15) consisting of an opening passing through
(Continued)

the entire thickness of the capacitive roof (12) so as to emerge on each of the two opposing faces of the capacitive roof (12) and configured such that the point of connection (M1) between the capacitive roof (12) and the feed probe (13) and the point of connection (M2) between the capacitive roof (12) and the electrically conductive short-circuit wire (14) are arranged on either side of the slit (15).

21 Claims, 14 Drawing Sheets

(56) References Cited

U.S. PATENT DOCUMENTS

| | | | | |
|---|---|---|---|---|
| 2003/0011521 | A1 | 1/2003 | Edimo et al. | |
| 2004/0183735 | A1* | 9/2004 | Jecko | H01Q 9/0421 343/725 |
| 2005/0040992 | A1* | 2/2005 | Chirila | H01Q 1/243 343/770 |
| 2012/0068898 | A1 | 3/2012 | Clow et al. | |
| 2013/0194146 | A1* | 8/2013 | Lee | H01Q 1/243 343/767 |

FOREIGN PATENT DOCUMENTS

| | | | |
|---|---|---|---|
| GB | 2471012 | A | 12/2010 |
| JP | 2007-97115 | A | 4/2007 |

OTHER PUBLICATIONS

International Preliminary Report on Patentability dated Dec. 1, 2016 issued in corresponding application No. PCT/EP2015/080631; w/ English machine translation (28 pages).

* cited by examiner

WIRE-PLATE ANTENNA HAVING A CAPACITIVE ROOF INCORPORATING A SLOT BETWEEN THE FEED PROBE AND THE SHORT-CIRCUIT WIRE

TECHNICAL FIELD OF THE INVENTION

The invention relates to the field of a wire-plate antenna comprising a ground plane, at least one capacitive roof forming a first part of the radiant element, a feed probe connected to the capacitive roof and intended to be linked to a generator, and at least one electrically conductive short-circuit wire linking the capacitive roof and the ground plane and forming a second part of the radiant element.

The invention applies very generally to telecommunication systems, and more particularly to the communicating objects in which radio frequency devices (circuits and/or antennas) are present.

A particular field of application that is targeted, but not exclusively, relates to a geolocation device of an object, notably of a vehicle, comprising at least one such antenna configured so as to be able to transmit to a remote server, via a communication system notably of GSM type, the different positions of said device by virtue of an association with a geolocation system, notably of GPS type.

STATE OF THE ART

A wire-plate antenna as defined above is a known structure, known for example from the U.S. Pat. No. 6,750,825A1. While such an antenna does offer, with respect to the antennas of the prior art, the advantages of being relatively simple in its design and production, of having small dimensions relative to the wavelength of use, of being adaptable to a suitable gain, the fact remains that frequency bandwidth is relatively narrow.

In addition, the use of a slit formed in the capacitive roof with, on a same side of this slit, the feed probe and the short-circuit wire to miniaturize a wire-plate antenna, is a known technique. This technique allows for the miniaturization of the antenna or, in other words, makes it possible to reduce the resonance frequency of the antenna. By elongating the slit, the resonance frequency of the antenna structure decreases. The slit modifies the equivalent capacitance of the antenna by increasing its value as a function of its length. This arrangement does not however allow for a significant increase in bandwidth. In practice, it rather risks involving a reduction of this bandwidth.

Another known structure is a wire-plate antenna with multiband slit. The slit is arranged on the capacitive roof over a significant part of its periphery, in proximity to the peripheral edges, so as to separate the capacitive roof into two areas and thus create two distinct resonances. In one of these areas, there are arranged the points of connection of the capacitive roof respectively to the feed probe and to the short-circuit wire, on one and the same side of the slit. These two resonances linked to the two areas are used separately and each of them is a resonance of wire-plate type. This particular wire-plate antenna offers operation with several bandwidths (multiband antenna). However, the bandwidth still remains narrow. In effect, this method does not make it possible to bring the two resonances sufficiently close together to use them jointly and thus widen the bandwidth.

Another known wide bandwidth planar antenna is the so-called "Goubau" antenna. This is an antenna in which the capacitive roof is delimited into four sectors via two secant slits. This antenna combines several resonance modes in order to obtain a wide band antenna, namely a first resonance of wire-plate type, for example in the region of 400 MHz, with a strong current on the short-circuit wires, a second charged monopol resonance, for example in the region of 720 MHz, with a strong current on the feed wires and a third resonance due to the wire connecting the feed wires and the short-circuit wires together, for example in the region of 980 MHz. This antenna makes it possible to obtain a very wide bandwidth. However, its construction is very complex.

OBJECT OF THE INVENTION

The aim of the present invention is to propose a wire-plate antenna which remedies the drawbacks listed above.

In particular, one object of the invention is to provide such a wire-plate antenna that has a mechanical structure that is simple and of little bulk and that makes it possible to obtain a very wide operating bandwidth.

This object can be achieved by virtue of a wire-plate antenna comprising a ground plane, at least one capacitive roof, a feed probe connected to the capacitive roof and intended to be linked to a generator, and at least one electrically conductive short-circuit wire linking the capacitive roof and the ground plane, said wire-plate antenna being such that the capacitive roof comprises at least one slit consisting of an opening passing through the entire thickness of the capacitive roof so as to emerge on each of the two opposing faces of the capacitive roof and configured such that the point of connection between the capacitive roof and the feed probe and the point of connection between the capacitive roof and the electrically conductive short-circuit wire are arranged on either side of the slit.

The wire-plate antenna may have no discrete component placed at the level of the slit.

The slit can be of rectilinear form, of meandering form or divided into several sections linked to one another to form a non-discontinuous slit.

The slit can be configured such that the ratio between its length and its width is greater than 5, even greater than 10.

The ground plane, the capacitive roof, the feed probe, said at least one electrically conductive short-circuit element and said at least one slit can notably be parameterized such that the wire-plate antenna exhibits a first resonance mode of wire-plate type and a second slit resonance mode respectively at first and second distinct resonance frequencies, said first and second resonance frequencies being adapted such that the wire-plate antenna exhibits a single and continuous operating frequency bandwidth.

The slit can be configured so as to exhibit an equivalent electrical length equal to half the wavelength associated with said second resonance frequency of the wire-plate antenna, said slit being closed at its ends.

The slit can alternatively be configured so as to exhibit an equivalent electrical length equal to a quarter of the wavelength associated with said second resonance frequency of the wire-plate antenna, said slit being open at at least one of its ends by emerging on one of the peripheral edges of the capacitive roof.

The wire-plate antenna can comprise at least one other electrically conductive short-circuit wire whose point of connection to the capacitive roof is situated on the same side as or on the opposite side from, relative to the slit, the point of connection between the capacitive roof and the feed probe.

The feed probe can start from a point of the ground plane then be split to come to be connected to the capacitive roof at several distinct points of connection.

The slit can form a non-zero angle, notably lying between 45° and 90°, with the direction linking the point of connection between the capacitive roof and the feed probe and the point of connection between the capacitive roof and the electrically conductive short-circuit wire.

The electrically conductive short-circuit wire and the feed probe can be formed on one and the same substrate placed at right angles to the ground plane and to the capacitive roof.

A geolocation device of an object, notably of a vehicle, will be able to comprise at least one such wire-plate antenna configured so as to transmit, to a remote server via a communication system, for example of GSM type, the different positions of the device by virtue of an association with a geolocation system, for example of GPS type.

The invention relates also to an object including a geolocation device comprising an antenna as defined previously.

The invention relates also to a radio communication device comprising an antenna as defined previously.

BRIEF DESCRIPTION OF THE DRAWINGS

Other advantages and features will emerge more clearly from the following description of particular embodiments of the invention given as nonlimiting examples and represented in the attached drawings, in which.

DESCRIPTION OF PREFERRED EMBODIMENTS OF THE INVENTION

Figure 1:
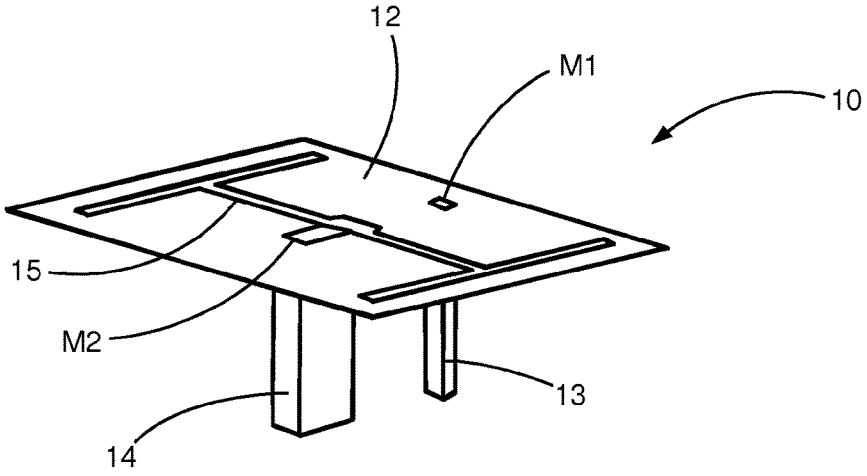
FIGS. 1 to 3 are perspective, plan and cross-sectional views of a first embodiment of a wire-plate antenna according to the invention.

The invention which will now be described with reference to FIGS. 1 to 20 relates generally to a wire-plate antenna 10 comprising a ground plane 11, at least one capacitive roof 12, a feed probe 13 connected to the capacitive roof 12 and intended to be linked to a generator, and at least one electrically conductive short-circuit wire 14 linking the capacitive roof 12 and the ground plane 11. In particular, the capacitive roof 12 constitutes a first part of the radiant element and the electrically conductive short-circuit wire 14 constitutes a second part of the radiant element.

The invention applies very generally to telecommunication systems, and more particularly to the communicating objects in which radio frequency devices (circuits and/or antennas) are present.

A particular field of application that is targeted, but not exclusively, relates to a geolocation device of an object, notably of a vehicle, comprising at least one such wire-plate antenna with slit configured so as to transmit to a remote server, via a communication system, for example of GSM type, the different positions of the device by virtue of an association with a geolocation system, for example of GPS type.

The term "GPS" means "Global Positioning System" and the term "GSM" means "Global System for Mobile Communications". They are elements that are fully known to those skilled in the art.

In particular, provision will be able to be made for the feed probe 13 to be able for example to pass through the ground plane 11 for connection to a power source. In this case, an insulation with the ground plane 11 must be provided.

Provision can be made for the presence or absence of a dielectric substrate between the ground plane 11 and the capacitive roof 12, at least over a part of their interface. The nature and the design of this substrate will be able to be parameters of which account must be taken when setting the wire-plate antenna 10.

The capacitive roof 12 delimits at least one slit 15 configured such that the point of connection M1 between the capacitive roof 12 and the feed probe 13 and the point of connection M2 between the capacitive roof 12 and the electrically conductive short-circuit wire 14 (connected to the ground plane 11) are arranged on either side of the slit 15. The slit 15 consists of an opening (or a hole) passing through the entire thickness of the capacitive roof 12 so as to emerge on each of the two opposing faces of the capacitive roof 12.

In other words, at the level of the capacitive roof 12, the slit 15 is arranged between the feed probe 13 and the electrically conductive short-circuit wire 14.

It will be noted that the size of the ground plane 11 impacts directly on the bandwidth of the antenna according to the invention. The ground plane 11 can be of small dimensions relative to the wavelength of operation of the wire-plate antenna 10. It can for example consist of the electronic circuit board of a WIFI router incorporating a pico-cell functionality of 3G or 4G type on which the antenna 10 would be placed.

The ground plane 11 can also be very large relative to the wavelength of operation of the wire-plate antenna 10. It can for example be a car roof or an airplane fuselage.

The wires necessary for the feed probe 13 and for the short-circuit wire 14 of the antenna 10 can be produced in different ways and can have different profiles (circular, polygonal, etc.). They can for example be simple metal cylinders, forming spacers between the roof 12 and the ground plane 11, that would be welded or screwed to the roof 12 of the antenna and to the ground plane 11 (with respect to the short-circuit wire 14). There can also be printed on a dielectric substrate which would be placed at right angles between the ground plane 11 and the roof 12 of the antenna 10. Therefore, according to a particular embodiment, the electrically conductive short-circuit wire 14 and the feed probe 13 are formed on one and the same substrate placed at right angles to the ground plane 11 and to the capacitive roof 12. The two wires can be used as mechanical support for the roof 12 of the antenna. Plastic spacers can also be used to ensure this function. The positioning and the diameter of the feed probe 13 and short-circuit 14 wires will have an impact on the resonance frequencies and on their adaptation. These two geometrical parameters are therefore setting parameters for the wire-plate antenna 10 with slit described in this document. They must be placed on either side of the slit 15.

Optionally, the feed probe 13 starts from a point of the ground plane 11 then is divided to be connected to the capacitive roof 12 at several distinct points of connection.

Figure 2:
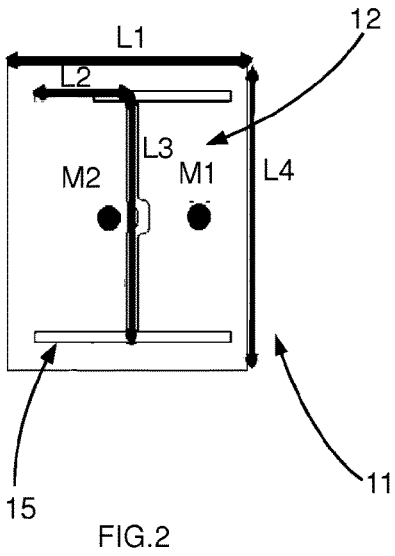
Figure 3:
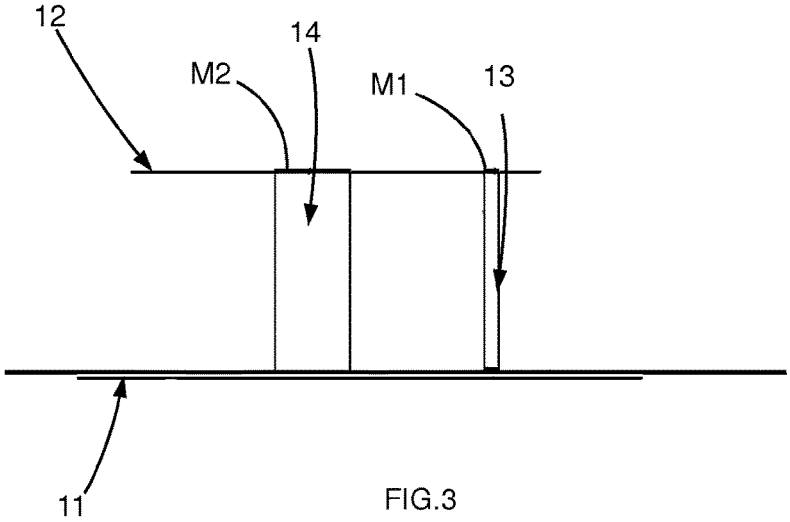
Figure 14:
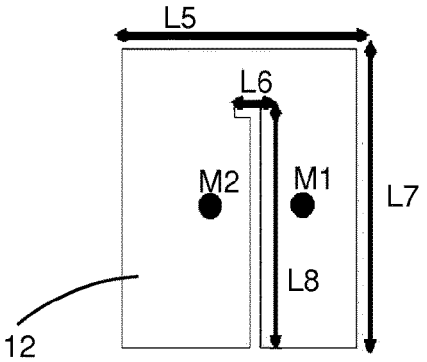
FIG. 14 is a plan view of a second embodiment of a wire-plate antenna according to the invention.

A first embodiment of a wire-plate antenna 10 with slit according to the invention is represented in FIGS. 1 to 3 and a second embodiment of a wire-plate antenna 10 according to the invention is represented in FIG. 14.

The formation of such a slit 15 makes it possible, on the one hand, for the wire-plate antenna 10 with slit to exhibit two distinct resonance modes as will be detailed later, namely a first resonance mode of wire-plate type and a second resonance mode of slit type, on the other hand to bring the two frequencies of these two resonance modes sufficiently close together to use them jointly. Thus, the wire-plate antenna 10 with slit allows a combination of the two resonance modes in order to significantly widen the bandwidth of operation relative to a same antenna without such a slit 15, or, conversely, to reduce the dimensions and the mechanical complexity of the antenna for a given bandwidth of operation. The combination of these two modes of operation allows for a bandwidth gain greater than 2 while retaining a stable radiation.

More specifically, as will be detailed later, the fact that a slit 15 is placed between the feed probe 13 and the short-circuit wire 14 makes it possible to create a second resonance mode close to the first resonance mode of wire-plate type. These two resonance modes are combined in order to make it possible to obtain a bandwidth gain of the order of 3 (for the case of a slit 15 of closed form) relative to an identical conventional wire-plate antenna but without such a slit 15.

Referring to FIGS. 2 and 14, the slit 15 can for example form a non-zero angle, notably lying between 45° and 90°, with the direction linking the point of connection M1 between the capacitive roof 12 and the feed probe 13 and the point of connection M2 between the capacitive roof 12 and the electrically conductive short-circuit wire 14.

The slit 15 can be of rectilinear form, in the form of meanders or divided into several sections linked to one another to form a non-discontinuous slit, for example in the form of an H as is illustrated in FIGS. 1 and 2. The form of the slit 15 as such is not an essential factor, unlike its equivalent electrical length.

Figure 17:
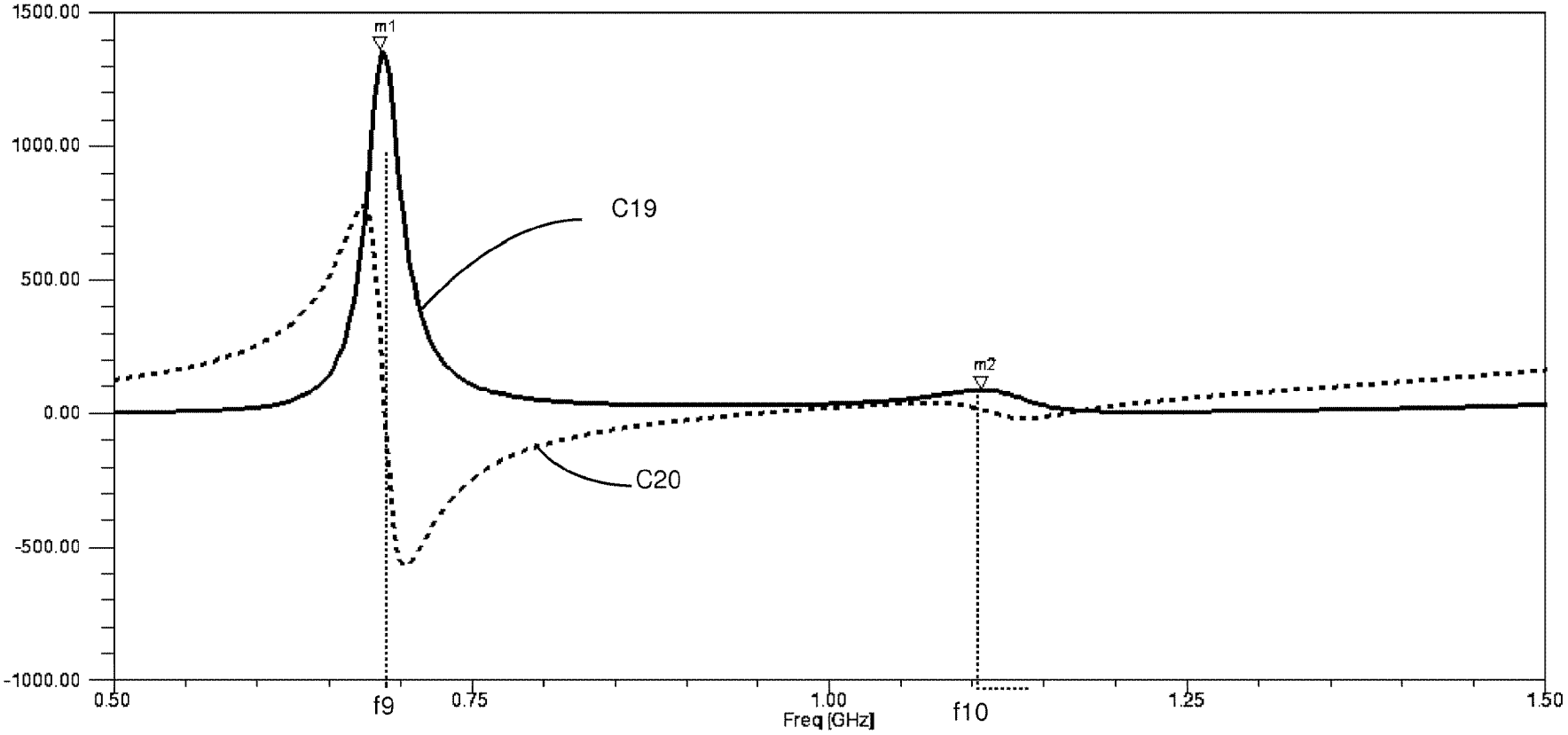
FIG. 17 shows the curves C19 and C20 respectively illustrating the real impedance and the imaginary impedance of the antenna as a function of the frequency for the second embodiment.

Generally, care will in particular be able to be taken to ensure that the ground plane 11, the capacitive roof 12, the feed probe 13, the electrically conductive short-circuit element 14 and the slit 15 are parameterized such that the wire-plate antenna 10 exhibits the first resonance mode of wire-plate type and the second slit resonance mode respectively at first and second distinct resonance frequencies f3, f4 (visible in FIG. 8), these first and second resonance frequencies being adapted such that the wire-plate antenna 10 exhibits a single and continuous operating frequency bandwidth. In the second embodiment, the first resonance frequency will be denoted f9 and the second resonance frequency will be identified f10 as illustrated in FIG. 17.

In other words, the different dimensional structural parameters of the wire-plate antenna 10 with slit (in particular those associated with the ground plane 11, with the capacitive roof 12, with the feed probe 13, with the electrically conductive short-circuit element 14 and with the slit 15) are parameterized such that the first operating frequency bandwidth associated with the first resonance mode of wire-plate type and the second operating frequency bandwidth associated with the second slit resonance mode overlap at least partially in the frequency spectrum of operation of the wire-plate antenna 10 with slit. For that, care will be taken, in the dimensioning and the design of the antenna 10, to ensure that the first and second resonance frequencies f3, f4 are not too far apart from one another, to avoid any phenomenon of multiband operation of the antenna which would correspond to an operation of the antenna 10 in which it would be unusable, at least in part, between said first and second resonance frequencies, which is not sought. On the contrary, the at least partial overlapping of the first and second bandwidth associated respectively with the first resonance mode of wire-plate type and with the second slit resonance mode makes it possible for the wire-plate antenna 10 according to the invention to exhibit a single, continuous and very wide operating bandwidth. This gain in bandwidth, compared to the same wire-plate antenna but without the slit 15, is approximately 2 for the case of a slit 15 open at at least one of its ends (that is to say that the slit emerges on one side of the roof 12), and approximately 3 for the case of a slit 15 closed at its ends (the slit does not emerge on the sides of the roof 12).

According to a particular embodiment in which the slit 15 is closed at its ends, which is the case of the first embodiment, the slit 15 will preferentially be configured so as to exhibit an equivalent electrical length equal to half of the wavelength associated with the second desired resonance frequency f4 of the wire-plate antenna 10, to within 5%.

The "equivalent electrical length", also known as "effective electrical length", is a parameter that is fully known to those skilled in the art, who are able to determine, by calculation or by simulation, from the knowledge of the dimensions and construction parameters of the wire-plate antenna 10 with slit, such as the dimensions and the material of the capacitive roof 12, the dimensions and the form of the slit 15, the dimensional and structural characteristics of each short-circuit wire 14 and of the feed probe 13, dimensional and structural characteristics of the ground plane 11, the relative distance separating each of these elements from one another, dimensional and structural characteristics of any dielectric material arranged between the ground plane 11 and the capacitive roof 12 . . . . The electrical length is the geometrical length rounded to the wavelength. The term "equivalent" is used when the wavelength in vacuum is taken as reference, corresponding to the length in vacuum to obtain a same phase shift (reflection conducted on the propagation of a wave).

According to one embodiment, the slit 15 is configured such that the ratio between its length and its width is greater than 5, even greater than 10. Thus, the slit 15 has a length very much greater than its width, this width being able to be variable to control the equivalent electrical length thereof.

The antenna does not include any discrete component, active or passive, such as capacitive elements, placed along the slit 15. In particular, the antenna does not include any discrete components connected on either side of the slit. Thus, the design of the antenna is particularly simple and a double resonance can be achieved, of optimized characteristics, without needing to add additional components at the slit level. This simplifies the dimensioning of the antenna.

FIGS. 4 to 13 show different curves representative of the operation of the first embodiment as illustrated in FIGS. 1 to 3, for which the width L1 of the roof 12 is 44 mm, the length L2 of a lateral half-branch of the H formed by the slit 15 is 18 mm, the length L3 of the main branch of the H formed by the slit 15 is 42 mm and the length L4 of the roof 12 is 56 mm. The slit 15 is therefore, in this first embodiment, a slit in the form of an H made up of two slits of 36 mm linked together by a slit of 42 mm. The slit 15 has a constant width of 2 mm, this width of 2 mm being very much less than the abovementioned lengths.

The capacitive roof 12 is a roof, for example of metal, in which the slit 15 is formed, here in the form of an H for example, of closed form (the slit does not emerge on one side of the roof). The equivalent electrical length of the slit is equal to half the wavelength associated with the second resonance frequency f4, to within 5%. On either side of the slit 15, the short-circuit wire 14 is connected to the point M2 and the wire corresponding to the feed probe 13 is connected to the point M1, this probe 13 being connected directly to a line delivering a radio frequency signal. Each short-circuit wire 14 is connected to the ground plane 11 which can be finite or infinite and on which electronic components can be positioned. The capacitive roof 12 of the wire-plate antenna 10 can be fabricated from a metal foil (for example tinned copper or any other metal offering a very good conductivity close to that of copper). The capacitive roof 12 of the wire-plate antenna with slit 10 can, among other things, be a simple piece of metal in which the slit 15 is machined and/or cut to the dimensions and forms desired. It can for example be produced in the manner of a printed circuit, that is to say printed on a dielectric substrate. In this case, the substrate used will allow the miniaturization of the wire-plate antenna with slit 10 as a function of the value of its relative permittivity.

Geometrical parameters for setting the antenna in terms of resonance of wire-plate type, as described in the U.S. Pat. No. 6,750,825A1, and the dimensions, the forms, and the positions of the slit 15, make it possible to set the resonance frequencies f3, f4 of the first and second resonance modes and to adapt them. The positioning and the diameter of the feed probe 13 and of the short-circuit wires 14 are also setting parameters for the wire-plate antenna 10.

As suggested previously, the width of the slit 15 can be constant over its entire length or vary in defined areas. For example, reducing the width of the slit 15 at its center (on the side of its point of symmetry for example) has the effect of lowering the second specific resonance frequency f4.

To establish the curves of FIGS. 4 to 13, a very large ground plane 11 (considered infinite) was considered. The electrically conductive short-circuit wire 14 is a rectangular parallelepiped measuring 7.7*3.6*21 $mm^3$ and the wire of the feed probe 13 is a rectangular parallelepiped measuring 1.5*2.7*21 $mm^3$.

The table below summarizes the essential characteristics of the first embodiment (right-hand column) by comparison with the same wire-plate antenna but without slit 15 (left-hand column):

| | Simple wire-plate | Slit wire-plate |
|---|---|---|
| Bandwidth (MHz) | 122.00 | 302.00 |
| f1 (MHz) | 915.00 | 922.00 |
| f2 (MHz) | 1037.00 | 1225.00 |
| Fc (MHz) | 976.00 | 1073.50 |
| Relative bandwidth (%) | 12.50 | 28.13 |

The frequency Fc (central frequency) is the average between the frequencies f1 and f2. The relative bandwidth expressed as a percentage is the ratio between the bandwidth expressed in MHz (corresponding to the difference between f2 and f1, defined hereinbelow) and the frequency Fc.

Figure 4:
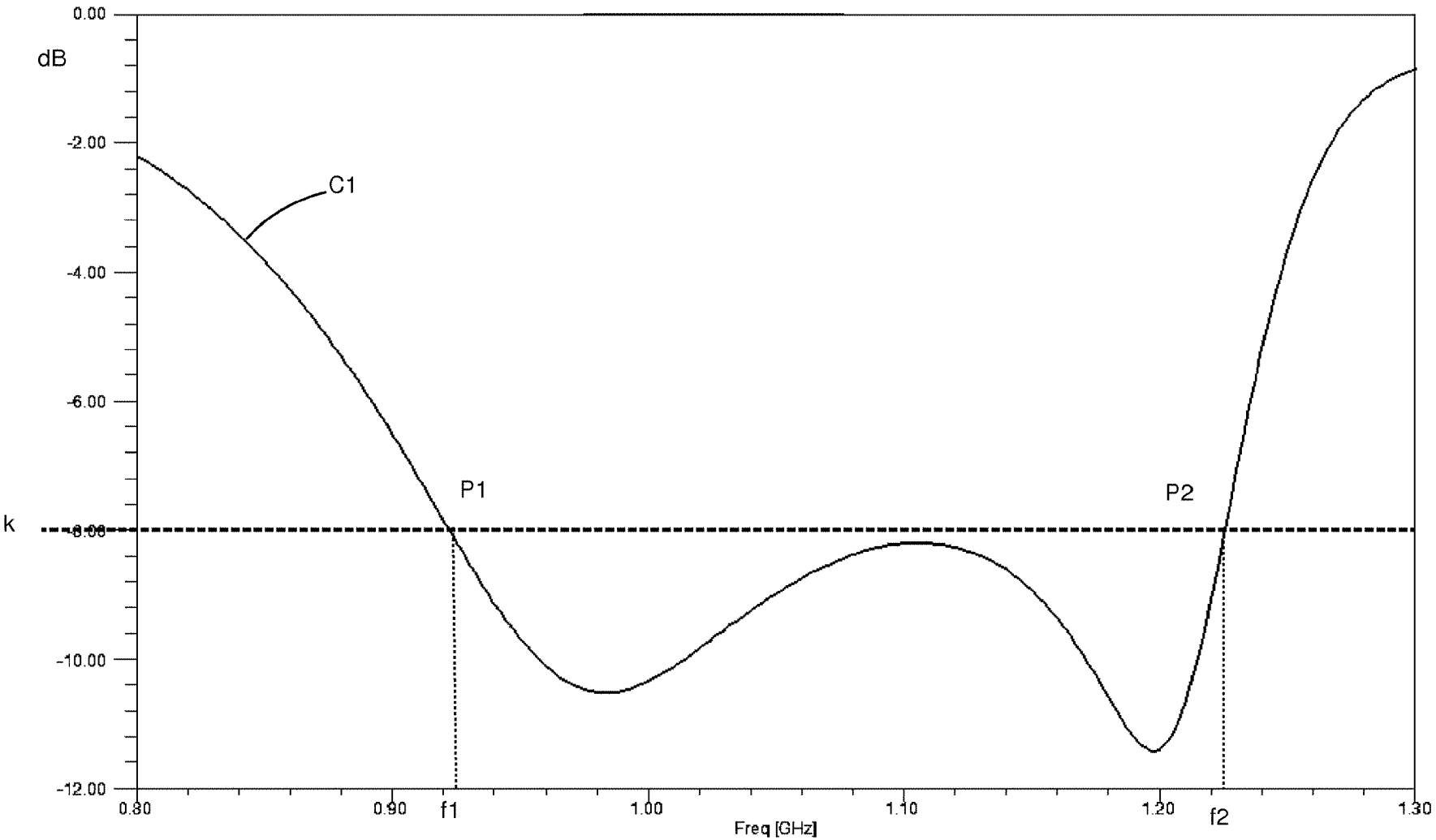
FIG. 4 represents, for a first embodiment, a curve C1 of the reflection coefficient of the antenna (in dB) as a function of the frequency, an impedance matching level k being also represented to define the bandwidth of the antenna between two frequencies f1 and f2.

FIG. 4 represents, for the first embodiment, a curve C1 illustrating the reflection coefficient (in dB) as a function of the frequency, k illustrating the impedance matching level desired, for example equal here to −8 dB.

In this first embodiment, the bandwidth of the wire-plate antenna 10 with slit is greater than 300 MHz (between the low frequency f1 equal to 922 MHz at the point P1 on the curve and the high frequency f2 equal to 1225 MHz at the point P2 on the curve). It is possible to bring the two resonance frequencies f3, f4 closer together in order to obtain a better matching level. For that, it would be necessary to modify the electrical length of the slit 15 and the size of the capacitive roof 12. A new adaptation of the wire-plate antenna 10 with slit may then be necessary by modifying the positions of the points M1, M2 and the diameters of the feed probe 13 and of each wire 14 present. The bandwidth is therefore defined as the frequency bandwidth over which the reflection coefficient is less than the threshold k, for example equal to −8 dB, as a function of the matching level sought.

Figure 5:
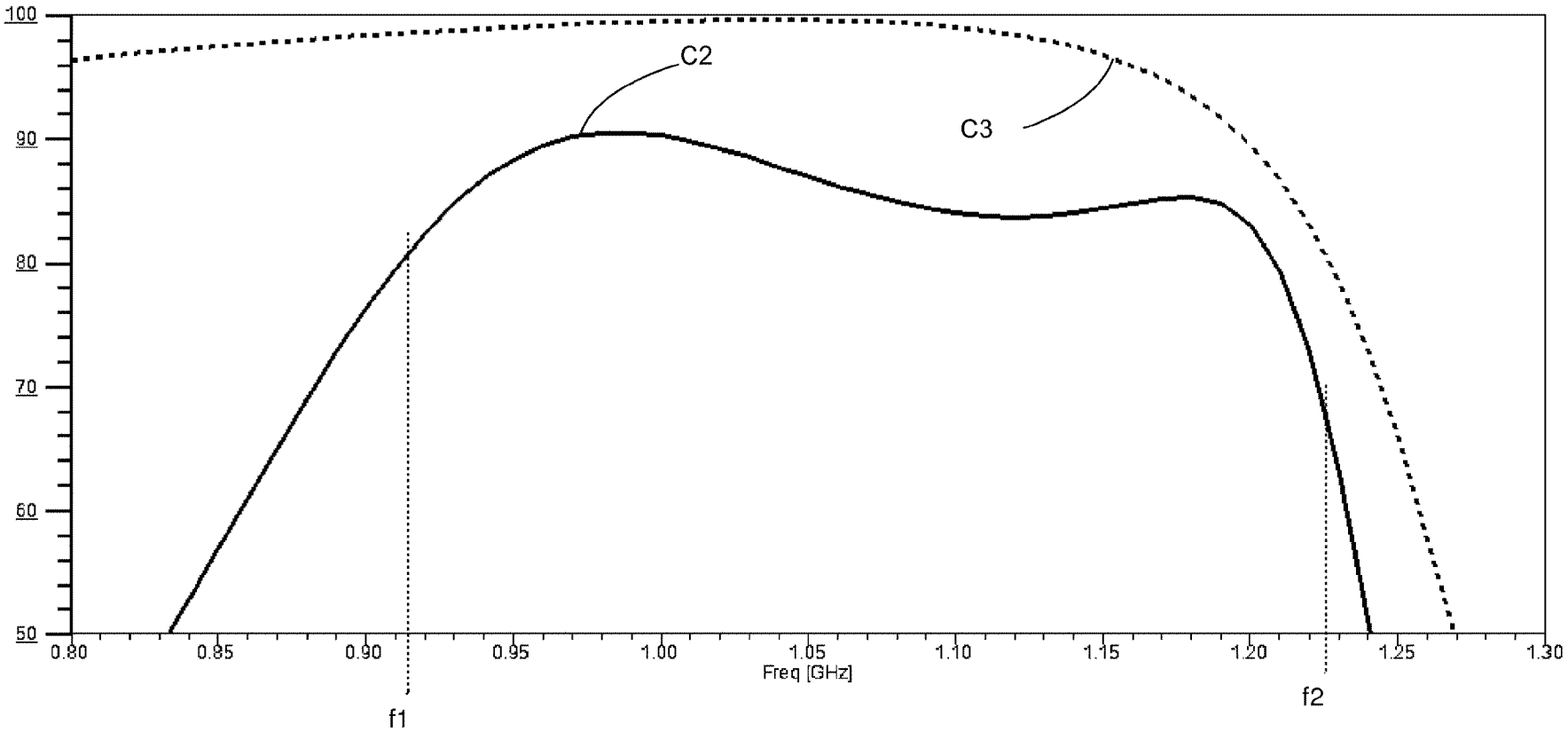
FIG. 5 represents, for the first embodiment, a curve C2 illustrating the total efficiency (%) of the antenna on its adaptation band and a curve C3 illustrating the radiation efficiency (%) of the antenna over its adaptation band.

FIG. 5 represents, for the first embodiment, the curve C2 illustrating the total efficiency (%) of the antenna over its adaptation band and the curve C3 illustrating the radiation efficiency (%) of the antenna over its adaptation band. An excellent efficiency is observed over the entire bandwidth bounded by the frequencies f1 and f2, particularly with a radiation efficiency >70%.

Figure 6:
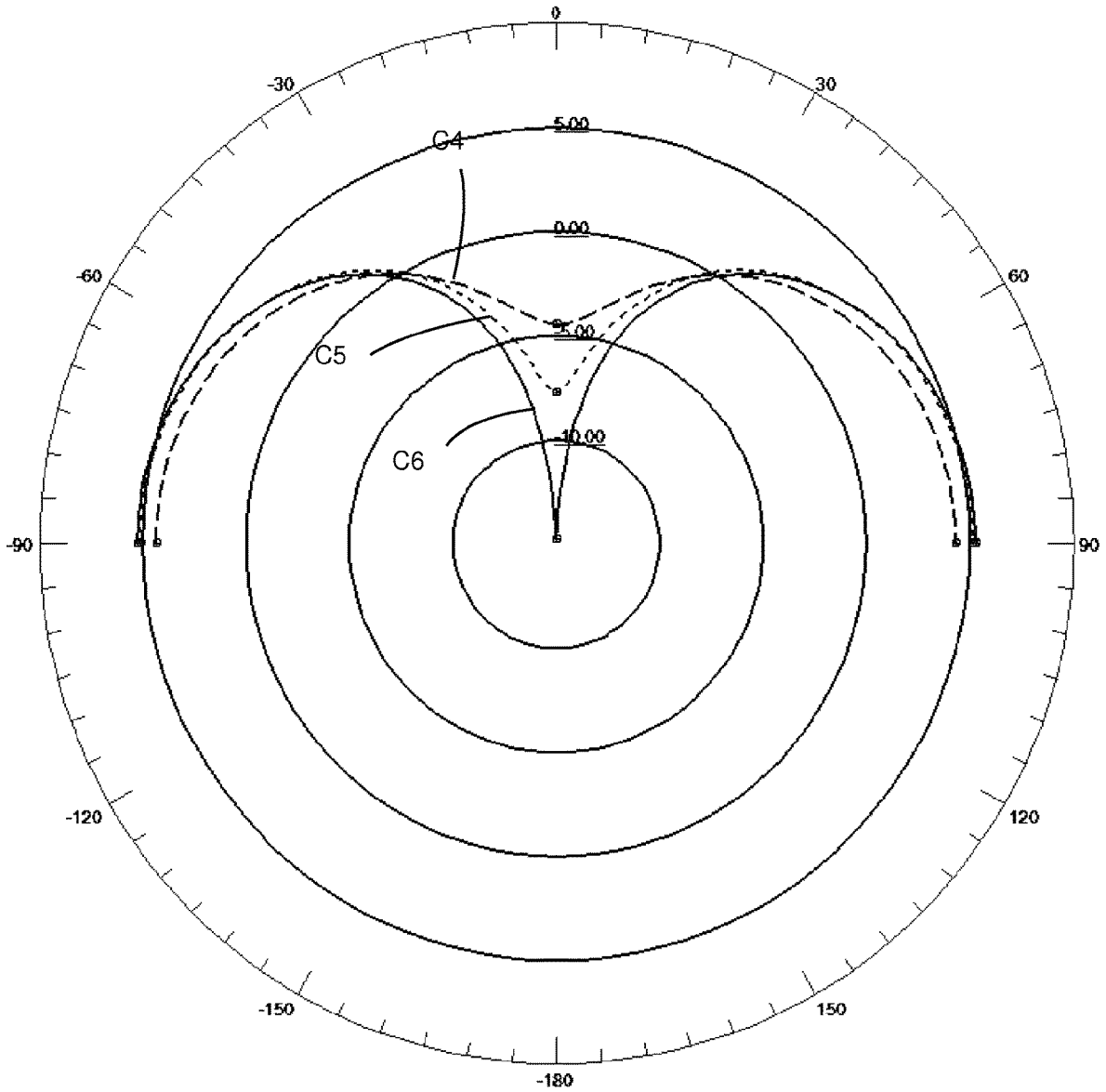
FIG. 6 represents the gain patterns of an antenna according to the invention (respectively corresponding to the curves C4 to C6) at 3 different frequencies, respectively equal to 1200 MHz, 1100 MHz and 950 MHz, for the first embodiment.

FIG. 6 represents the total gain patterns (respectively corresponding to the curves C4 to C6) at 3 different frequencies, respectively equal to 1200 MHz, 1100 MHz and 950 MHz, for the first embodiment. The ground plane 11 of the wire-plate antenna 10 with slit is considered as infinite. These curves validate a radiation stability over the entire band of operation f1-f2 of the wire-plate antenna 10 with slit.

Figure 7:
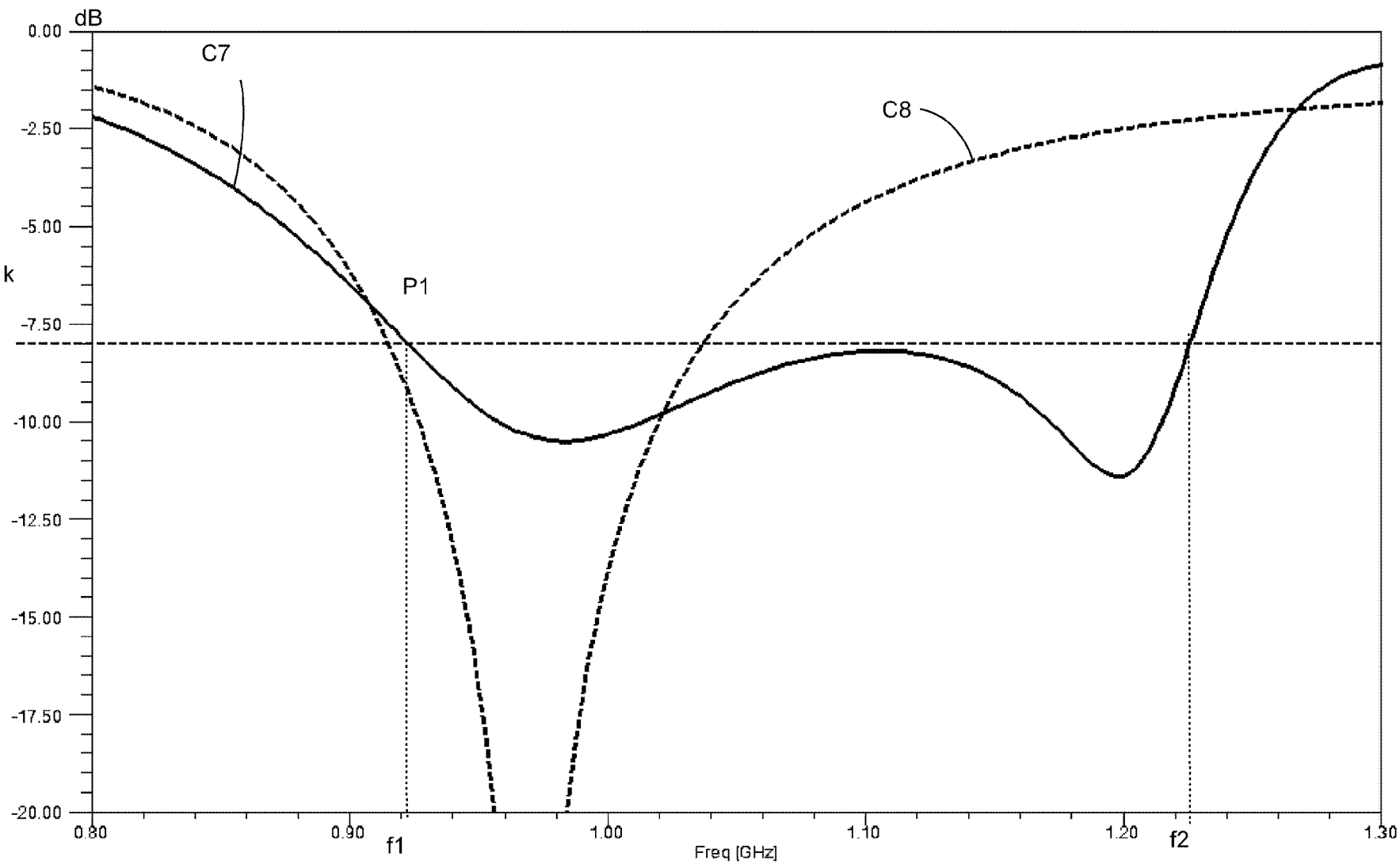
FIG. 7 represents a curve C7 of the reflection coefficient (in dB) as a function of the frequency for the first embodiment, a curve C8 of the reflection coefficient (in dB) as a function of the frequency for a wire-plate antenna of the prior art, identical to the first embodiment but without slit, an impedance matching level k being illustrated to define the bandwidth of the antenna between frequencies f1 and f2.

FIG. 7 represents the curve C7 illustrating the reflection coefficient (in dB) as a function of the frequency for the first embodiment, the curve C8 illustrating the reflection coefficient (in dB) as a function of the frequency for a wire-plate antenna of the prior art, identical to the first embodiment but without the slit 15, a threshold k corresponding to the level of impedance matching desired being represented. This FIG. 7 shows the frequencies f1 and f2 expressed previously and the points P1 and P2. The curve C8 shows that, in the absence of the slit 15, the same wire-plate antenna but without the slit 15 exhibits a low bandwidth, of the order of 120 MHz, narrower than the bandwidth obtained in the case of the presence of the slit 15.

Figure 8:
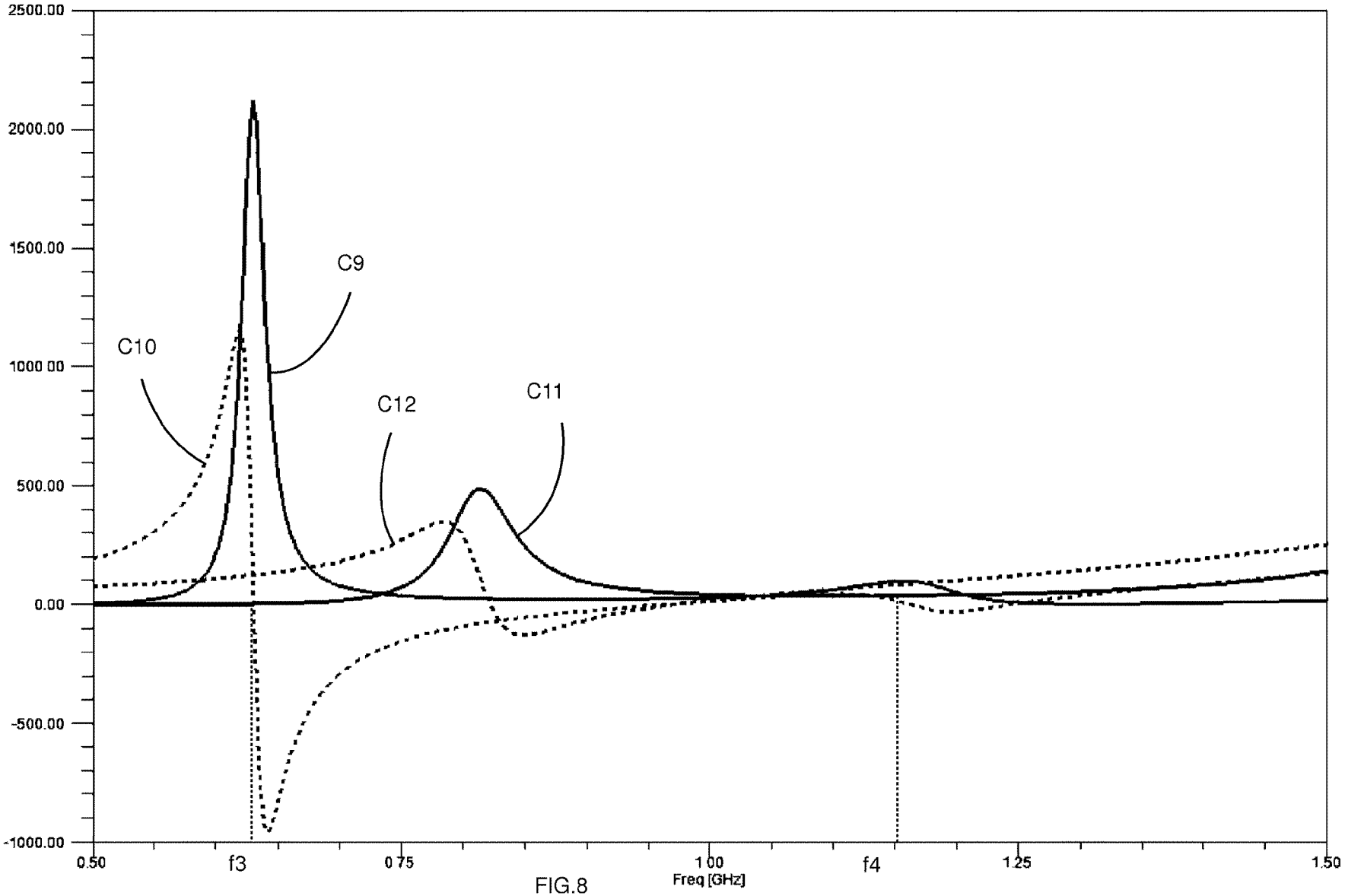
FIG. 8 shows curves C9 and C10 respectively of the real impedance and of the imaginary impedance of the antenna according to the invention as a function of the frequency for the first embodiment, and curves C11 and C12 respectively of the real impedance and of the imaginary impedance as a function of the frequency for a wire-plate antenna of the prior art, identical to the first embodiment but without slit.

FIG. 8 shows curves C9 and 010 respectively illustrating the real impedance and the imaginary impedance of the antenna as a function of the frequency for the first embodiment, and curves C11 and C12 respectively illustrating the real impedance and the imaginary impedance as a function of the frequency for a wire-plate antenna of the prior art, identical to the first embodiment but without slit 15. In this FIG. 8, via the curves C9 and 010, there are once again therefore the resonance frequencies f3 and f4 expressed previously respectively in the regions of 650 MHz and 1150 MHz. The second resonance spike at the frequency f4 allows the desired bandwidth gain, notably via an appropriate adaptation of the equivalent electrical length of the closed slit 15 for the resonance spikes to meet to augment the bandwidth. Conversely, via the curves C11 and C12, it can be seen that the same wire-plate antenna, but without the slit 15, exhibits a single resonance spike (in the region of 825 MHz), therefore a bandwidth significantly narrower than in the context of the invention.

Figure 11:
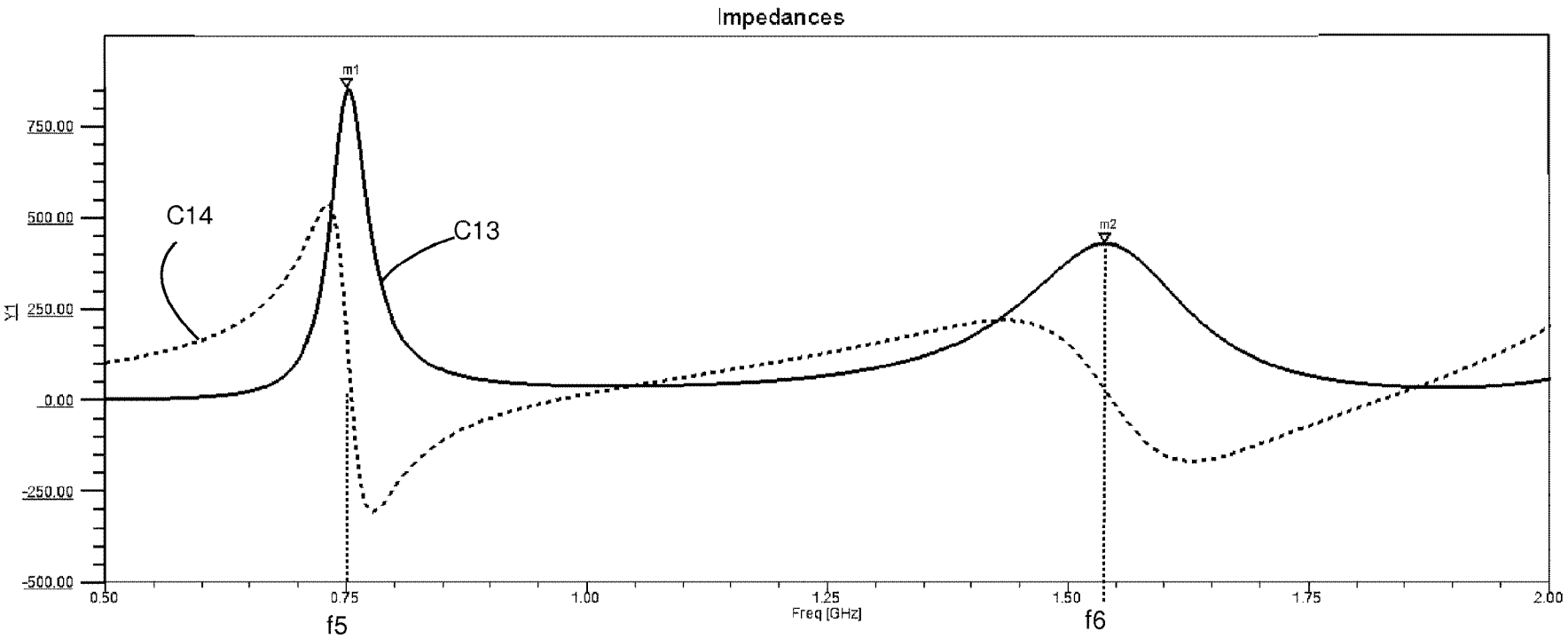
FIG. 11 represents the curves C13 and C14 respectively illustrating the real impedance and the imaginary impedance as a function of the frequency for a wire-plate antenna comprising a slit but outside of the scope of the invention.

FIG. 11 represents the curves C13 and C14 respectively illustrating the real impedance and the imaginary impedance as a function of the frequency for a wire-plate antenna comprising a slit dimensioned so as to be outside of the scope of the invention. This slit notably exhibits an equivalent electrical length which is not dimensioned as previously. The resonance frequency of the resonance mode of wire-plate type is identified f5 in the region of 753 MHz, whereas the resonance frequency of the slit resonance mode is identified f6 in the region of 1540 MHz. The frequencies f5 and f6 are therefore significantly further apart from one another than the frequencies f3 and f4. The result thereof is then that the two resonance modes are not combined as in the case of the wire-plate antenna 10 presented previously. Such an antenna on the contrary exhibits a multiband operation in which it can be used on two distinct bandwidths separated from one another but in which it cannot be used between these two bandwidths, which is not sought when a wide and continuous bandwidth is desired.

Figure 12:
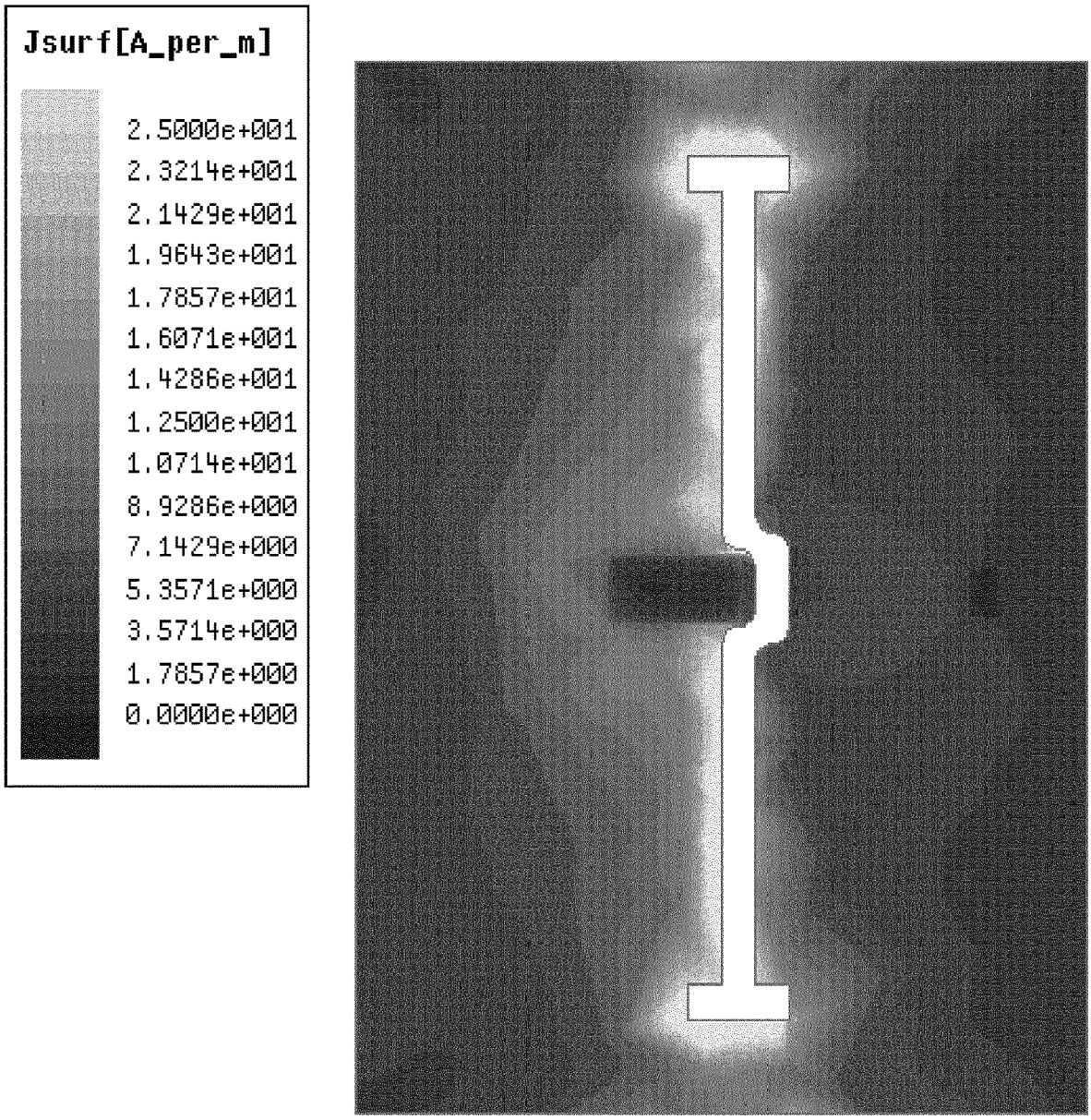
FIG. 12 represents, for said wire-plate antenna comprising a slit but outside of the scope of the invention, the intensity of the surface currents at the resonance of wire-plate type.
Figure 13:
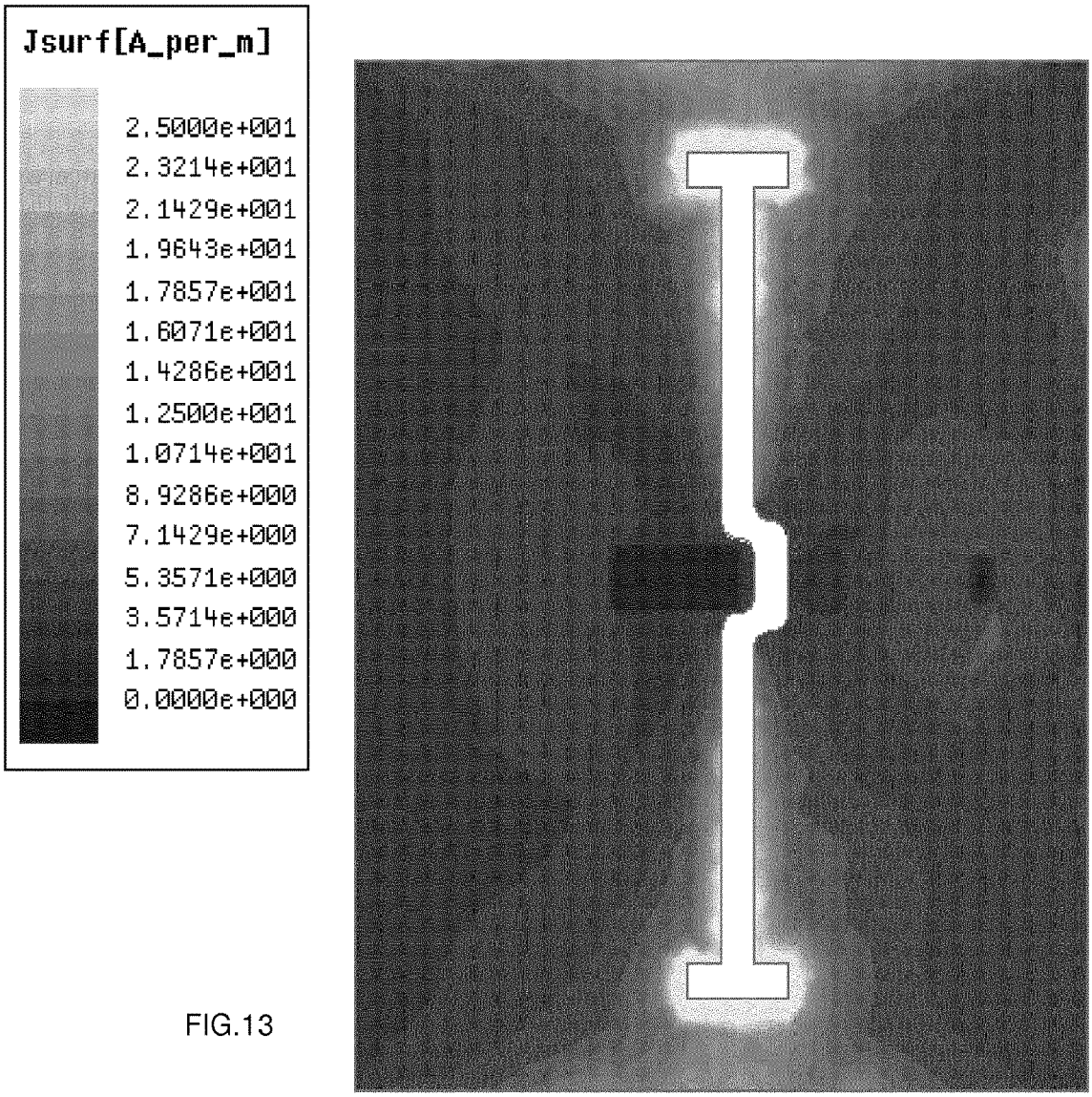
FIG. 13 represents, for said wire-plate antenna comprising a slit but outside of the scope of the invention, the intensity of the surface currents at the slit resonance.

To establish FIGS. 11 to 13, a slit was considered having an equivalent electrical length very much less than half of the wavelength associated with the frequency of the second resonance which is of slit type. In effect, the shorter the equivalent electrical length of the slit, the higher the second resonance frequency, associated with the slit resonance mode, and vice versa. This is essentially what explains how the frequency f6 is significantly higher than the frequency f4.

FIGS. 12 and 13 represent, for this wire-plate antenna comprising a slit outside of the scope of the invention, the intensity of the surface currents respectively at the resonance of wire-plate type and upon the slit resonance. Referring to FIG. 12, at the frequency f5 of 753 MHz, a strong current is seen on the structure at the level of the short-circuit wire 14 followed by a diffusion of this current throughout the capacitive roof 12 of the structure. This current distribution is typical of a resonance mode of wire-plate type. Referring to FIG. 13, at the frequency f6 of 1540 MHz, a very strong current is seen on the structure at the two ends of the slit and that reduces along the slit to its center where it is almost zero. This current distribution is typical of a closed slit resonance mode. The two resonance modes are perfectly identifiable separately and with certainty.

Figure 9:
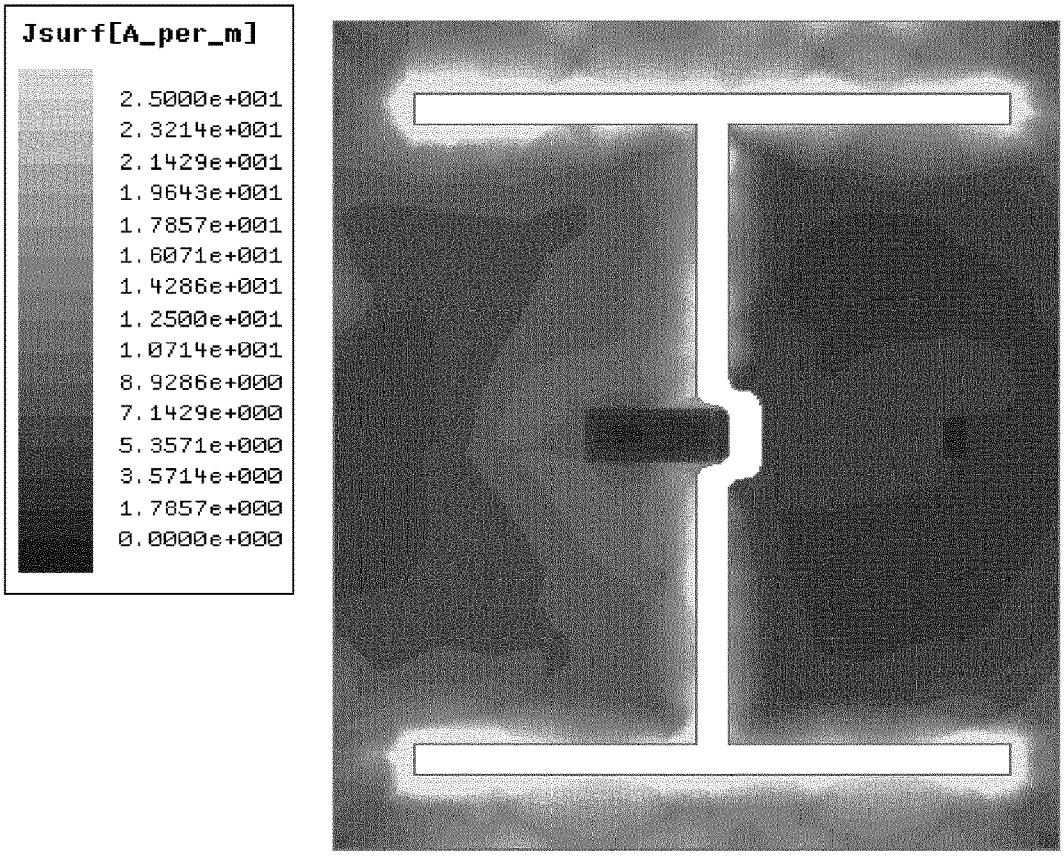
FIG. 9 represents, for the first embodiment, the intensity of the surface currents at the resonance of wire-plate type.
Figure 10:
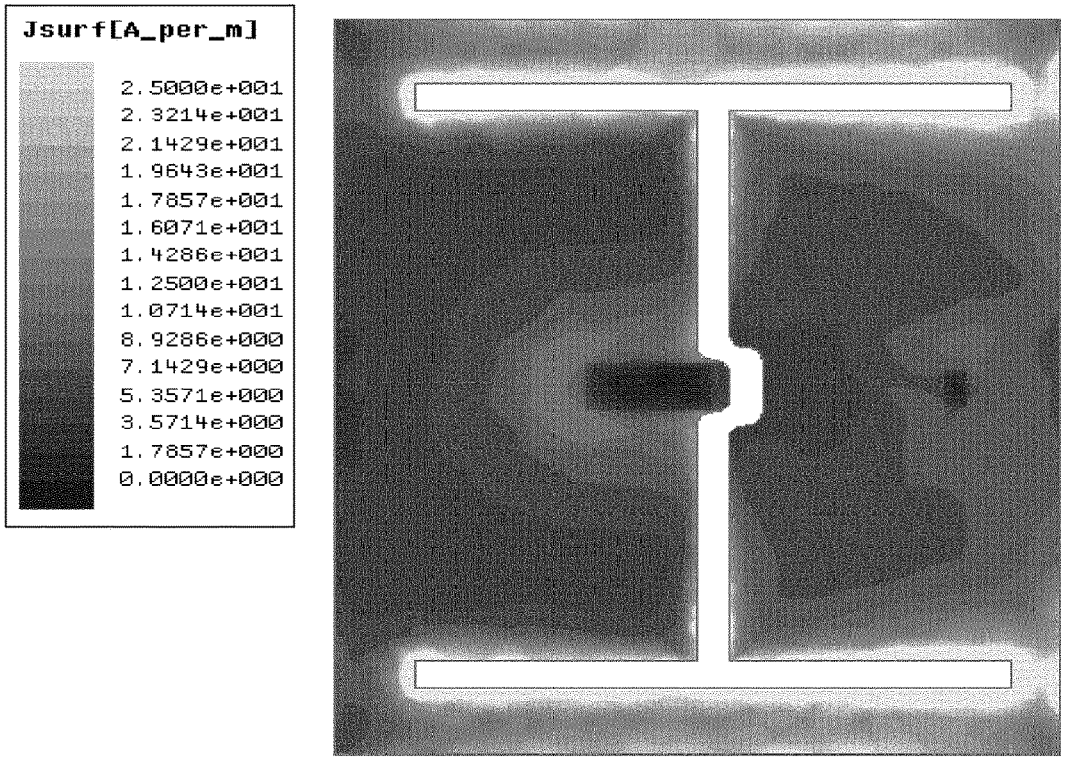
FIG. 10 represents, for the first embodiment, the intensity of the surface currents at the slit resonance.

FIGS. 9 and 10 now represent, for the first embodiment of the wire-plate antenna according to the invention, the intensity of the surface currents in the roof 12 respectively at the resonance of wire-plate type and at the slit resonance. The same characteristics are found as in FIGS. 12 and 13 but in a more diffuse and less marked manner. In effect, for this structure in which the two resonances at the frequencies f3 and f4 are much closer to one another than in the case of the resonance spikes at the frequencies f5 and f6, it is difficult to completely disassociate the two resonances and thus identify them as easily as previously. That favors an overlapping of the bandwidths of the two resonance modes so as to offer a single and wide bandwidth and a stable far-field radiation.

Figure 15:
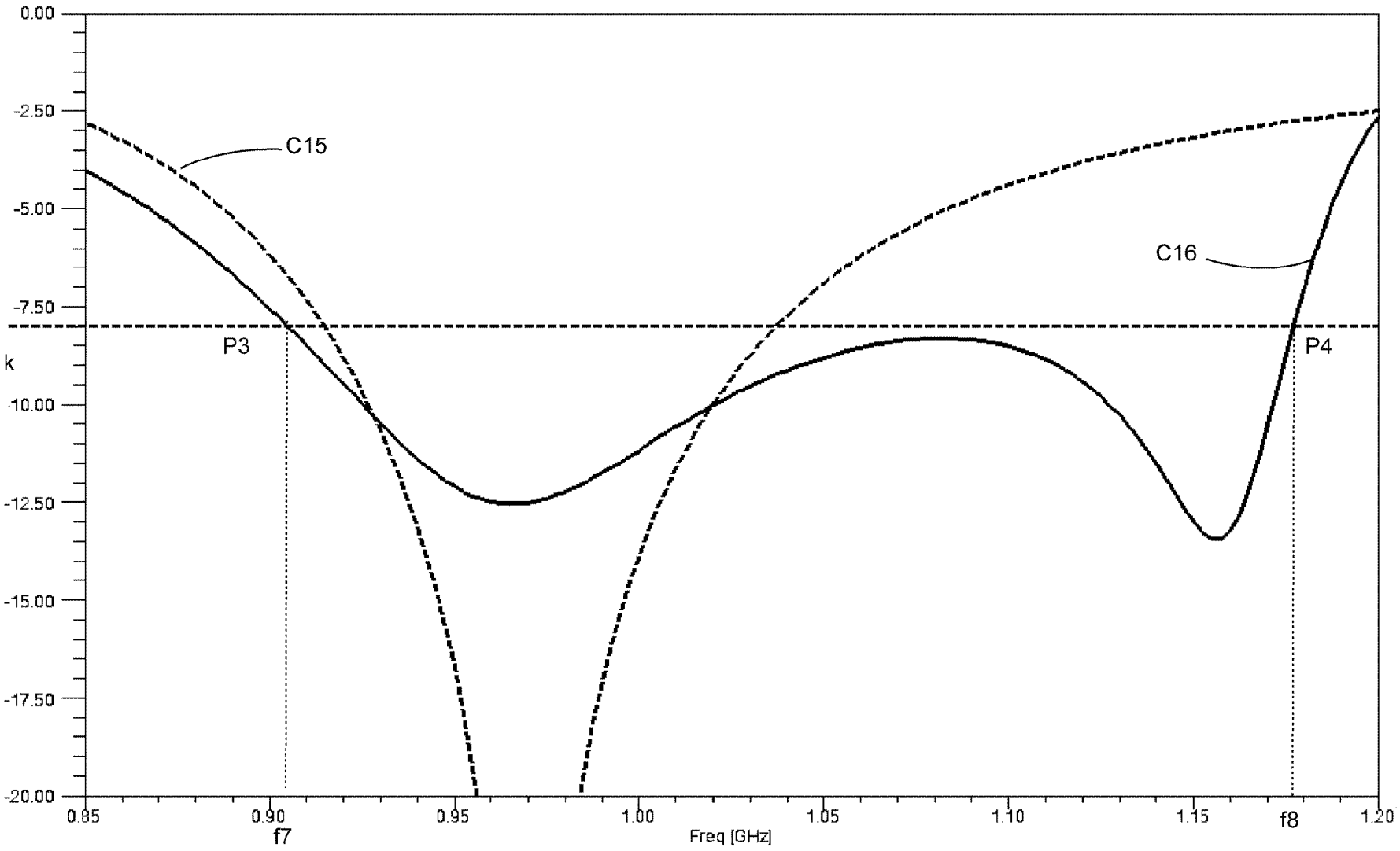
FIG. 15 represents a curve C16 of the reflection coefficient (in dB) as a function of the frequency for the second embodiment, a curve C15 of the reflection coefficient (in dB) as a function of the frequency for a wire-plate antenna of the prior art, identical to the second embodiment but without slit, and an impedance matching level k defining the bandwidth of the antenna between the frequencies f1 and f2.
Figure 16:
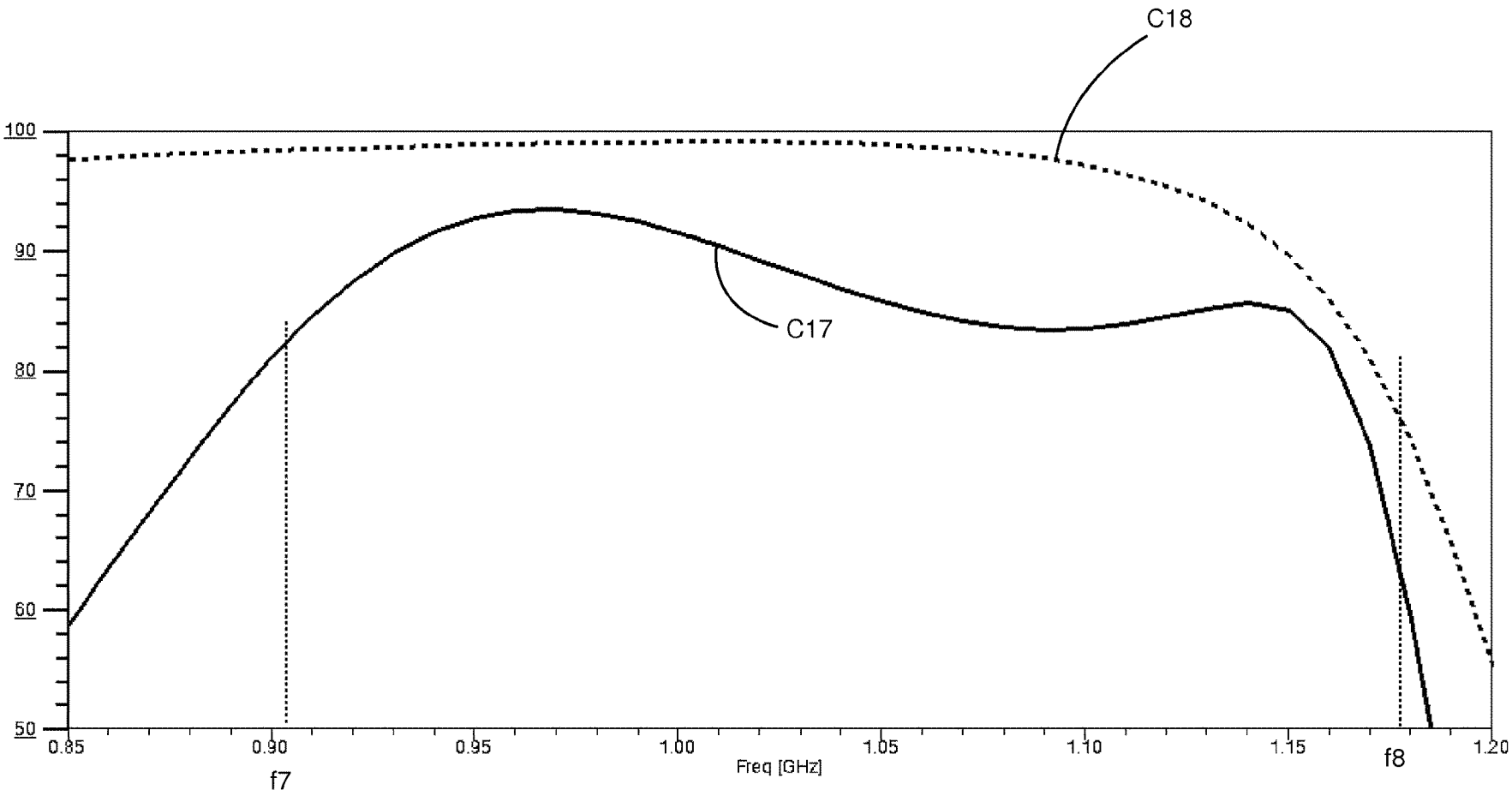
FIG. 16 represents, for the second embodiment, a curve C17 of the total efficiency (%) of the antenna over its adaptation band and a curve C18 of the radiation efficiency (%) of the antenna over its adaptation band.

FIG. 14 is now a plan view of the second embodiment of a wire-plate antenna 10 with slit according to the invention, in which the slit 15 is open at at least one of its ends emerging on one of the peripheral edges of the capacitive roof 12. FIGS. 15 to 17 show different curves representative of the operation of the second embodiment as illustrated in FIG. 14, for which the width L5 of the roof 12 is 44 mm, the length L6 of the single lateral branch of the slit 15 is 5 mm, the length L8 of the main branch of the slit 15 is 45 mm and the length L7 of the roof 12 is 56 mm.

Care will notably be taken to ensure that the slit 15 is configured so as to exhibit an equivalent electrical length equal to a quarter of the wavelength associated with the second resonance frequency f10 of the wire-plate antenna 10 desired, to within 5%. The first resonance frequency of the wire-plate antenna 10 is in this case that identified f9. The resonance frequencies f9, f10 are represented in FIG. 17. The single bandwidth is bounded by the frequencies f7 and f8 detailed later.

The table below summarizes the essential characteristics of the second embodiment (right-hand column) in comparison with the same wire-plate antenna but without the slit 15 (left-hand column):

| | Simple wire-plate | Slit wire-plate |
|---|---|---|
| Bandwidth (MHz) | 122.00 | 272 |
| f7 (MHz) | 915.00 | 905 |
| f8 (MHz) | 1037.00 | 1177 |

-continued

| | Simple wire-plate | Slit wire-plate |
|---|---|---|
| Fc (MHz) | 976.00 | 1041 |
| Relative bandwidth (%) | 12.50 | 26.13 |

FIG. 15 represents a curve C16 illustrating the reflection coefficient (in dB) as a function of the frequency for the second embodiment, a curve C15 illustrating the reflection coefficient (in dB) as a function of the frequency for a wire-plate antenna of the prior art, identical to the second embodiment but without slit 15, a threshold k corresponding to the impedance matching level desired being represented.

In this second embodiment according to the invention, the bandwidth of the wire-plate antenna 10 with slit (bounded by the frequencies f7 and f8) is of the order of 270 MHz, for an impedance matching level of −8 dB (FIG. 15), the low frequency f7 being of the order of 905 MHz (point P3 on the curve) and the high frequency f8 being of the order of 1177 MHz (point P4 on the curve). This bandwidth therefore exhibits a gain greater than 2 relative to the bandwidth of 122 MHz of the same antenna but without the open slit: the curve C15 shows that, in the absence of the open slit 15, the same wire-plate antenna exhibits a low bandwidth, only 122 MHz, significantly narrower than the bandwidth equal to 272 MHz (between the frequencies f7, f8) obtained in the case of the presence of the open slit 15.

FIG. 16 represents, for the second embodiment, the curve C17 illustrating the total efficiency (%) of the antenna over its adaptation band and the curve C18 illustrating the radiation efficiency (%) of the antenna over its adaptation band. An excellent efficiency is observed over the entire bandwidth bounded by the frequencies f7 and f8, notably with a radiation efficiency >70%.

FIG. 17 shows the curves C19 and C20 respectively illustrating the real impedance and the imaginary impedance as a function of the frequency for the second embodiment. In this figure, the curves C19 and C20 therefore show again the frequencies f9 and f10 expressed previously, corresponding to the first and second resonance frequencies, respectively in the regions of 687 MHz and 1107 MHz. This second frequency f10 specifically allows the bandwidth gain, notably via a suitable adaptation of the equivalent electrical length of the open slit 15.

The second embodiment with open slit offers the same advantages as the first embodiment with closed slit, namely, combining the two resonance modes of wire-plate type and of slit type in order to augment the operating bandwidth of an antenna without changing the dimensions or the mechanical complexity thereof. As mentioned previously, for a same roof surface, the first embodiment (closed slit) allows an increase in the bandwidth greater than that of the second embodiment.

Figure 18:
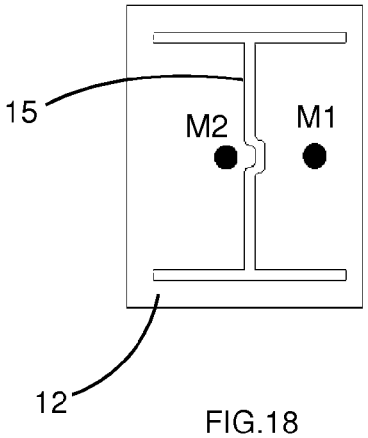
FIGS. 18 to 20 show, in plan view, different configurations that can be envisaged for the feed probe and for the short-circuit wire or wires relative to the slit.

FIG. 18 schematically represents, by plan view, the distribution of the points of connection M1 and M2 relative to the slit 15 when the wire-plate antenna 10 with slit comprises only a single feed probe 13 and only a single electrically conductive short-circuit wire 14.

Figure 20:
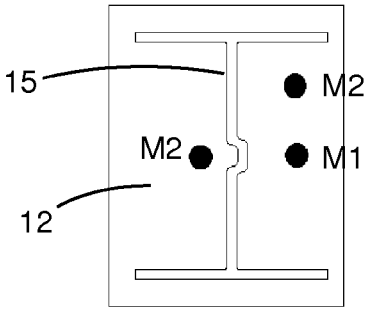

Referring to FIG. 20, whatever the variant considered, the wire-plate antenna 10 with slit comprises at least one other electrically conductive short-circuit wire 14 whose point of connection M2 to the capacitive roof 12 is situated on the same side, relative to the slit 15, as the point of connection M1 between the capacitive roof 12 and the feed probe 13.

Figure 19:
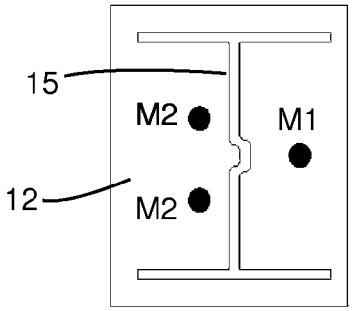

Referring to FIG. 19, whatever the variant considered, the wire-plate antenna 10 with slit can also comprise at least one other electrically conductive short-circuit wire 14 whose point of connection M2 to the capacitive roof 12 is situated on the same side, relative to the slit 15, as the point of connection M2 between the capacitive roof 12 and the first electrically conductive short-circuit wire 14, that is to say that the two points of connection M2 are arranged on the side opposite, relative to the slit 15, the point of connection M1 between the capacitive roof 12 and the feed probe 13. It is still possible for the wire-plate antenna 10 to also be able to comprise at least one other electrically conductive short-circuit wire 14 whose point of connection M2 to the capacitive roof 12 is situated on the side opposite, relative to the slit 15, the point of connection M2 between the capacitive roof 12 and the first electrically conductive short-circuit wire 14.

Figure 21:
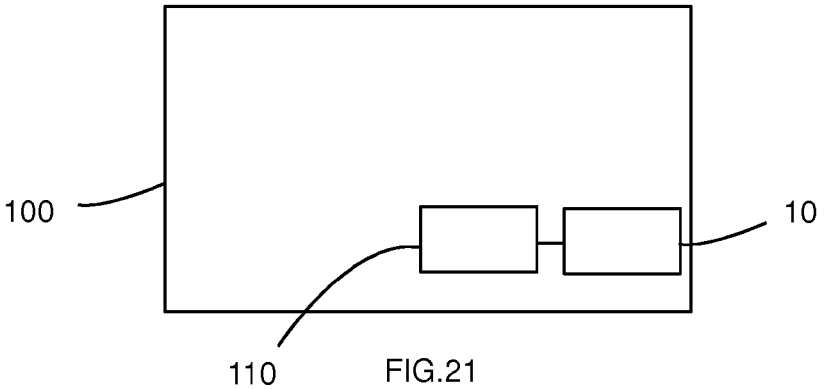
FIG. 21 represents an embodiment of a radio communication device according to the invention.

The invention relates also to a radio communication device 100 comprising an antenna 10 according to the invention, in particular a wire-plate antenna as described previously. An embodiment of such a device is represented in FIG. 21. The device can comprise a module 110 for generating and/or analyzing electrical signals coupled or connected to the antenna 10.

Figure 22:
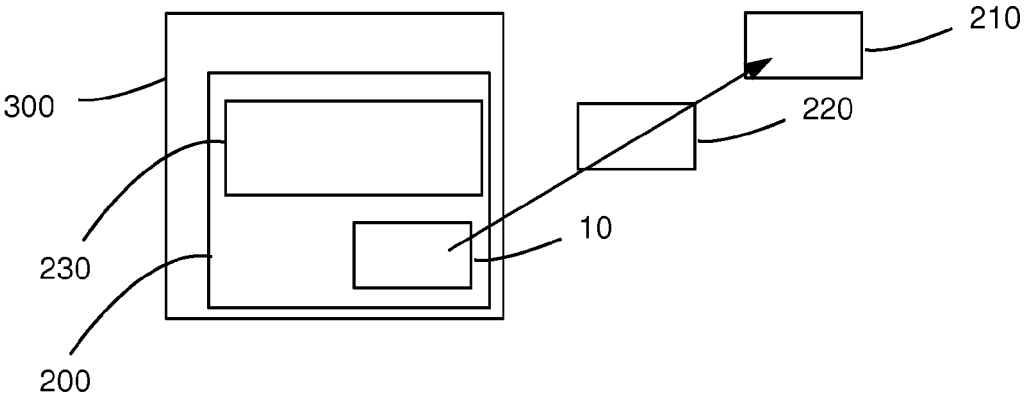
FIG. 22 represents an embodiment of a geolocation device of an object according to the invention.

The invention relates also to a geolocation device 200 of an object 300, notably a vehicle 300, comprising at least one wire-plate antenna 10 described previously and configured so as to transmit to a remote server 210, via a communication system 220, for example of GSM type, the different positions of the device by virtue of an association with a geolocation system 230, for example of GPS type. An embodiment of such a device is represented in FIG. 22.

The invention relates finally to the object 300 including a geolocation device 200 comprising a geolocation system 230 and a wire-plate antenna according to the invention, notably a wire-plate antenna as described above.

Throughout this document, the frequency bandwidth of operation is preferably defined as the set of the frequencies for which the reflection coefficient of the antenna is less than −8 dB.

In all the embodiments, preferably, the capacitive roof is made of a single piece. Thus, preferably, no slit separates the roof into two parts that are distinct or remote from one another.

The invention claimed is:

1. A wire-plate antenna comprising:

a ground plane, at least one capacitive roof, a feed probe connected to the capacitive roof and intended to be linked to a generator, and at least one electrically conductive short-circuit wire linking the capacitive roof and the ground plane, wherein the capacitive roof comprises at least one slit consisting of an opening passing through the entire thickness of the capacitive roof so as to emerge on each of two opposing faces of the capacitive roof and configured so that the point of connection between the capacitive roof and the feed probe and the point of connection between the capacitive roof and the electrically conductive short-circuit wire are arranged on either side of the slit, wherein the ground plane, the capacitive roof, the feed probe, the at least one electrically conductive short-circuit element and the at least one slit are parameterized so that the wire-plate antenna exhibits a first resonance mode of wire-plate type and a second slit resonance mode respectively at first and second distinct resonance frequencies, the first and second resonance frequencies being adapted so that the wire-plate antenna exhibits a single and continuous operating frequency bandwidth including the first wire-plate type resonance frequency and the second slit resonance frequency, the slit being configured so as to exhibit an equivalent electrical length equal to half the wavelength associated with the second resonance frequency of the wire-plate antenna, wherein the wire-plate antenna comprises no discrete component placed at the level of the slit, and wherein the slit is closed at its ends.

2. The wire-plate antenna as claimed in claim 1, wherein the slit is of rectilinear form, of meandering form or divided into several sections linked to one another to form a non-discontinuous slit.

3. The wire-plate antenna as claimed in claim 1, wherein the slit is configured so that the ratio between its length and its width is greater than 5.

4. The wire-plate antenna as claimed in claim 1, comprising at least one other electrically conductive short-circuit wire whose point of connection to the capacitive roof is situated on the same side as or on the opposite side from, relative to the slit, the point of connection between the capacitive roof and the feed probe.

5. The wire-plate antenna as claimed in claim 1, wherein the feed probe starts from a point of the ground plane then is split to come to be connected to the capacitive roof at several distinct points of connection.

6. The wire-plate antenna as claimed in claim 1, wherein the slit forms a non-zero angle with the direction linking the point of connection between the capacitive roof and the feed probe and the point of connection between the capacitive roof and the electrically conductive short-circuit wire.

7. The wire-plate antenna as claimed in claim 1, wherein the electrically conductive short-circuit wire and the feed probe are formed on one and the same substrate placed at right angles to the ground plane and to the capacitive roof.

8. A geolocation device of an object comprising at least one wire-plate antenna as claimed in claim 1 configured so as to transmit, to a remote server via a communication system, the different positions of the device by virtue of an association with a geolocation system.

9. A radio communication device comprising an antenna as claimed in claim 1.

10. A radio communication object including a geolocation device comprising a geolocation system and an antenna as claimed in claim 1.

11. The wire-plate antenna as claimed in claim 3, wherein the slit is configured so that the ratio between its length and its width is greater than 10.

12. The wire-plate antenna as claimed in claim 6, wherein the non-zero angle is in the range of from 45° to 90°.

13. The geolocation device according to claim 8, wherein the communication system is a GSM system, and the geolocation system is a GPS geolocation system.

14. The geolocation device according to claim 13, wherein the object is a vehicle.

15. The wire-plate antenna as claimed in claim 2, wherein the slit is configured so that the ratio between its length and its width is greater than 5.

16. The wire-plate antenna as claimed in claim 15, wherein the slit is configured so that the ratio between its length and its width is greater than 10.

17. The wire-plate antenna as claimed in claim 2, wherein the slit is configured so as to exhibit an equivalent electrical length equal to half the wavelength associated with the second resonance frequency of the wire-plate antenna.

18. The wire-plate antenna as claimed in claim 3, wherein the slit is configured so as to exhibit an equivalent electrical length equal to half the wavelength associated with the second resonance frequency of the wire-plate antenna.

19. The wire-plate antenna as claimed in claim 1, wherein the slit is in the shape of an H closed at its ends, and the points of connection between the capacitive roof and the feed probe and the electrically conductive short-circuit wire are arranged on either side of the middle branch of the H.

20. The wire-plate antenna as claimed in claim 1, wherein a radiation efficiency of the antenna within the single and continuous bandwidth is more than 70% over the operating range between the first and second resonance frequencies.

21. A wire-plate antenna comprising:

a ground plane, at least one capacitive roof, a feed probe connected to the capacitive roof and intended to be linked to a generator, and at least one electrically conductive short-circuit wire linking the capacitive roof and the ground plane, wherein the capacitive roof comprises at least one slit consisting of an opening passing through the entire thickness of the capacitive roof so as to emerge on each of two opposing faces of the capacitive roof and configured so that the point of connection between the capacitive roof and the feed probe and the point of connection between the capacitive roof and the electrically conductive short-circuit wire are arranged on either side of the slit, wherein the ground plane, the capacitive roof, the feed probe, the at least one electrically conductive short-circuit element and the at least one slit are parameterized so that the wire-plate antenna exhibits a first resonance mode of wire-plate type and a second slit resonance mode respectively at first and second distinct resonance frequencies, the first and second resonance frequencies being adapted so that the wire-plate antenna exhibits a single and continuous operating frequency bandwidth, wherein the slit is configured so as to exhibit an equivalent electrical length equal to a quarter of the wavelength associated with the second resonance frequency of the wire-plate antenna, and wherein the slit is open at at least one of its ends by emerging on a peripheral edge of the capacitive roof.

* * * * *